United States Patent [19]

Carruthers

[11] 4,429,692

[45] Feb. 7, 1984

[54] TRACTION FORCE ADJUSTMENT APPARATUS

[76] Inventor: George A. Carruthers, Forge Bridge Cottage, Caton, Lancaster, England, LA 2 9NB

[21] Appl. No.: 268,129

[22] Filed: May 29, 1981

[51] Int. Cl.[3] ..... A61H 1/02

[52] U.S. Cl. ..... 128/75

[58] Field of Search ..... 128/75, 84 R, 84 A, 128/84 B, 84 C, 71, 69; 254/124; 74/833, 522; 272/130

[56] References Cited

U.S. PATENT DOCUMENTS

| | | | |
|---|---|---|---|
| 2,940,442 | 6/1960 | Wilhem | 128/75 |
| 3,859,910 | 1/1975 | Swanson | 254/124 |
| 3,888,243 | 6/1975 | Powlan | 128/75 |
| 4,266,537 | 5/1981 | Bonin et al. | 128/75 |
| 4,275,882 | 6/1981 | Grosser et al. | 272/130 |
| 4,323,060 | 4/1982 | Pécheux | 128/75 |

*Primary Examiner*—C. Fred Rosenbaum
*Assistant Examiner*—J. L. Kruter
*Attorney, Agent, or Firm*—Austin R. Miller

[57] ABSTRACT

Apparatus for controlling traction force applied to a patient via a traction cord includes a lever mounted for rotation about a pivot, with the traction cord connected to the lever at a position on the lever remote from the pivot, a piston within a cylinder and movable in response to fluid pressure thereagainst in a direction generally transverse to the lever, a piston rod extending from the piston and journaled on the lever for movement therealong in response to piston movement and a hand screw connected to the piston rod intermediate the piston and the lever for displacing the piston rod along the lever while hydraulic pressure is applied to the piston.

18 Claims, 4 Drawing Figures

TRACTION FORCE ADJUSTMENT APPARATUS

BACKGROUND OF THE INVENTION

1. Field of the Invention

This invention relates to application of traction forces to human patients in connection with treatment of skeletal and connective tissue disorders.

2. Description of the Prior Art

Apparatus for treating human patients to alleviate problems in skeletal and connective tissues is disclosed in U.S. Pat. Nos. 3,033,198; 3,086,518; 3,710,787; 3,786,803; 3,835,847; 3,847,146; 3,888,243; 3,910,263 and 3,937,216.

Of greatest interest with respect to this invention are the U.S. Pat. No. 3,835,847 and U.S. Pat. No. 3,786,803. U.S. Pat. No. 3,835,847 discloses a traction force application device in which a lever allows hand adjustment of traction force applied. A knob controls a quick take-up and release mechanism with a pulley, biased by a spring, creating tension in a cord applying traction force. A lever assembly causes traction force to be maintained at a constant level once the force is selected.

U.S. Pat. No. 3,786,803 discloses a motor and gear arrangement driving a pulley to which a traction cord is attached, where the apparatus cyclically applies traction force to the patient. An eccentric wheel shifts to move a pulley assembly, bearing against a traction cord, to adjust traction force on each cycle.

Also of interest is U.S. Pat. No. 3,910,263 disclosing a traction force application device in which a pulley is movable to assure that a cord, via which traction force is applied, is oriented parallel to a piston rod applying force to the cable. Maintenance of the geometry of the cord-piston rod combination helps control the traction force.

Of lesser interest are the U.S. Pat. Nos. 3,888,243, 3,033,198 and 3,847,146 approaches. U.S. Pat. No. 3,888,243 uses fluid pressure, U.S. Pat. No. 3,847,146 uses a vacuum and U.S. Pat. No. 3,033,198 uses a weight and pulley system for applying traction force to patients. Also less relevant is U.S. Pat. No. 3,710,787, disclosing a reversible motor and gear train applying traction force to a patient. U.S. Pat. Nos. 3,086,518 and 3,937,216 disclose cylinders applying traction force to patients where hydraulic or pneumatic circuits associated with the cylinders apply pressure to a hydraulic piston.

Despite the well developed character of this art, the need remains for a highly portable traction apparatus usable by either a physician or a physiotherapist in a medical facility or even by a patient at home, allowing rapid, easy adjustment, within fine gradations, of the applied traction force by the physician, physiotherapist or patient and which can be rapidly disengaged from the patient should an emergency arise. A further need exists for traction apparatus which upon slippage of the traction harness wrapped around the patient does not result in application of large impulse force to the patient.

OBJECTS OF THE INVENTION

A principal object of this invention is to provide apparatus for controlling therapeutic traction force applied to a patient via a cord, in which the traction force can be changed by small amounts by an attending physician, physiotherapist or by the patient and in which slippage of the traction harness does not result in injury to the patient.

A second object of this invention is to provide methods and apparatus for adjustably controlling traction force applied to a patient by adjustably positioning an input force application means along a pivotable lever to which a traction cord is affixed.

SUMMARY OF THE INVENTION

This invention encompasses methods and apparatus for controlling therapeutic traction force applied to a patient via a cord providing a lever rotatable about a pivot where the lever is adapted for connection thereto of the cord at a position remote from the pivot, a member journaled against the lever and movable therealong, means for biasing the member against the lever and adjustable means connected to the member for displacing the member along the lever while force is applied to the member by the biasing means. Movement of the member along the lever changes the ratio of (1) the distance along the lever between the pivot and the position where the member is journaled against the lever to (2) the distance along the lever between the pivot and lever-cord connection point, thereby changing the force applied to the cord.

One embodiment of the invention includes a hollow housing. A lever interior of the housing and pivotally connected thereto at a fulcrum includes a generally planar pad. The lever is adapted for connection thereof of the cord at a position remote from the fulcrum. A closed hydraulic fluid reservoir containing a bladder filled with preferably compressible fluid is interior of and pivotally mounted to the housing for arcuate movement coplanarly with but independently of the lever. Upon introduction of hydraulic fluid into the reservoir the bladder transfers the pressure of the compressible fluid contained within it to the hydraulic fluid. A hydraulic cylinder is in fluid communication with the reservoir. A piston resident within the hydraulic cylinder is movable longitudinally therewithin in response to hydraulic fluid pressure within the cylinder against the piston. A first member is fixedly connected to the piston and is movable unitarily therewith. The member preferably extends from the piston to the lever pad and is generally transverse to the pad. Bearing means rollably contact the pad of the lever and have the first member journaled therein, facilitating movement of the member along the lever. A second member extends from the first member and is in the plane of movement of the lever and the reservoir. Bearing means connect the first and second members and facilitate angular movement of the first member along the lever upon longitudinal movement of the second member. Adjustable means are connected to the housing and receive the second member therewithin. The adjustable means longitudinally displace the second member in response to operator input.

The invention may include means located at fluid juncture of the hydraulic cylinder and the hydraulic reservoir, blocking flow of hydraulic fluid from the fluid reservoir into the cylinder while permitting fluid flow from the cylinder into the reservoir. A passageway connecting the cylinder and the reservoir allows flow of fluid therebetween. The passageway has substantially smaller cross-sectional area to flow than the cross-sectional area to flow of the fluid blocking and flow permitting means when that means is permitting flow.

The cylinder, piston and the first member preferably are all rotatable unitarily with the reservoir and in a common plane therewith.

The lever pad may be intermediate the fulcrum and lever-cord juncture or the fulcrum may be intermediate the lever pad and the lever-cord juncture.

DESCRIPTION OF THE PREFERRED EMBODIMENTS

The invention is used to control traction forces applied to a patient wearing a canvas band, web or similar support(s) to which one or more traction cords may be affixed. The patient may wear two harnesses spaced apart so that traction force as applied tends to further separate portions of the patient's body around which the harnesses are fixed. Typically one harness is connected by a cord to a fixed member secured to the frame of the bed on which the patient rests. The remaining harness is connected by a traction cord to apparatus embodying the invention.

Figure 1:
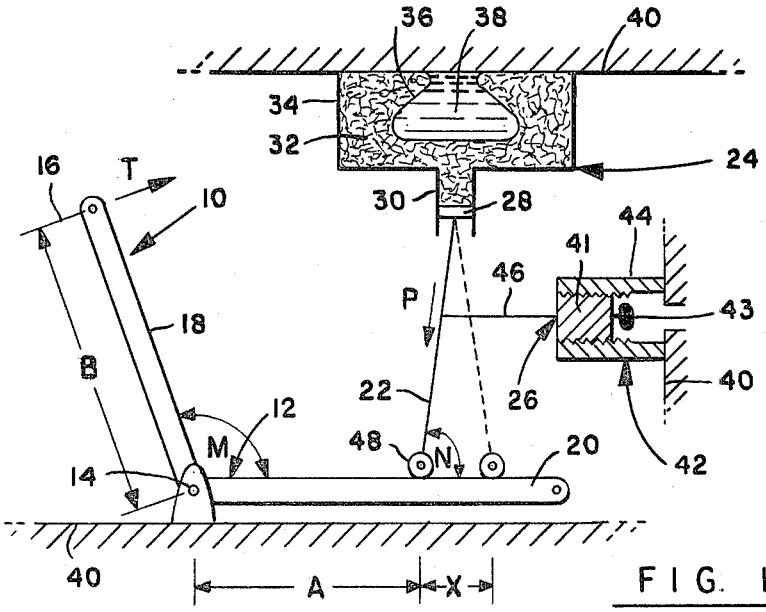
FIG. 1 is a schematic illustration of apparatus demonstrating principles of the invention.

Referring to FIG. 1, apparatus for controlling traction force applied to a patient via a traction cord, facilitating application of therapeutic traction force to the patient via the cord, is illustrated schematically and designated generally 10. The apparatus includes a lever 12 mounted for rotation about a fulcrum 14 with lever 12 adapted for connection thereto of a traction cord 16 remote from fulcrum 14. Lever 12 may have two portions; an output arm 18 to which traction cord 16 may be affixed and an input arm 20 extending away from output arm 18 at fulcrum 14. Alternatively, arms 18 and 20 can be merged into a single arm; in such case fulrum 14 is at one end of lever 12.

A rigid member 22 is biased against lever 12 and is movable therealong. Rigid member 22 preferably extends away from lever 12 in a direction generally transverse to the portion of lever 12 against which rigid member 22 is biased. Apparatus 10 includes means for biasing rigid member 22 against lever 12 by aplication of force to rigid member 22 along a direction generally transverse to portion 20 of lever 12 against which member 22 rides; this biasing means is denoted generally 24 in FIG. 1.

Apparatus 10 further includes preferably manually adjustable means, denoted generally 26 in FIG. 1, connected to rigid member 22 for displacing rigid member 22 along lever 12 while force is applied to rigid member 22 by biasing means 24. Adjustable means 26 for displacing rigid member 22 changes the ratio of distance along lever 12, from fulcrum 14 to where rigid member 22 is biased against portion 20, to distance along lever 12 between fulcrum 14 and the point at which cord 16 connects to lever 12. As displacement means 26 changes this ratio, force applied to cord 16 changes.

Biasing means 24 preferably includes a piston 28 within cylinder 30 and movable in response to pressure of preferably incompressible first hydraulic fluid 32, where piston 28 moves generally transversely to the portion of input arm 20 of lever 12 against which rigid member 22 is biased. Fluid 32 is retained within a reservoir 34. A bladder 36 within reservoir 34 retains compressible second fluid 38 therewithin. Pressure of first fluid 32 acting against piston 28 may be increased by introducing additional compressible second fluid 38 into bladder 36. Reservoir 34 is contained within and connected to a housing where the housing wall is denoted generally 40 in FIG. 1.

Displacing means 26 is preferably manually adjustable and connected to rigid member 22 intermediate piston 28 and lever 12. Means 26 preferably includes a hand adjustable screw assembly 42, comprising screw 41, handwheel 43 and nut 44, and may be affixed to housing wall 40. A rod 46 connects screw 41 to rigid member 22; rotation of screw 41 longitudinally displaces rod 46 in a direction generally transverse to rigid member 22.

Rigid member 22 is preferably journaled against lever 12 by a bearing roller 48 contacting lever 12 thereby facilitating movement of rigid member 22 along lever 12. The portion of lever 12 contacted by roller 48 is preferably a relatively wide planar pad-like portion, to facilitate rolling movement of roller 48 therealong.

The combination of rigid member 22 and biasing means 24, including piston 28, cylinder 30, reservoir 34, first hydraulic fluid 32, bladder 36 and second compressible fluid 38, acts as a spring, exerting force against lever 12 in a direction defined by the longitudinal axis of rigid member 22. Once the load is applied, the load may be varied by adjustment of screw 41. Internal stops preferably limit the range of movement of rigid member 22 along lever 12, thereby limiting the amount by which applied force may be varied and hence guarding against the physician, physiotherapist or patient accidently increasing the load excessively.

Pressure on piston 28 exerted by hydraulic fluid in cylinder 30 and in reservoir 34 produces a force on rigid member 22, indicated by arrow P. Rigid member 22 transmits force P to lever 12 via roller 48 contacting input arm 20 of lever 12 at a distance A from fulcrum 14. As lever 12 tries to rotate about fulcrum 14 in response to force P, a force denoted by arrow T is produced in traction cord 16 affixed to output arm 18 of lever 12. Force T is a multiple of force P where the multiplier is the ratio of distance A to distance B along the respective input and output arms 20, 18 of lever 12. A is the distance along input arm 20 from fulcrum 14 to roller 48 while B is the distance along output arm 18 from fulrum 14 to cord 16. The force multiplication quantitatively noted in the penultimate sentence is correct so long as forces P and T act perpendicularly to input and output arms 20, 18; as the angles of force application and delivery change slightly during operation of the invention, the quantitative expression for force multiplication noted above becomes an approximation.

When adjustment of force T is required, the physician, physiotherapist or patient rotates handwheel 43 thereby effecting movement of rigid member 22 along input arm 20 of lever 12. As rotation of handwheel 43 moves rigid member 22 from the position shown in solid lines to the position shown in dotted lines, with roller 48 being displaced an additional distance X from fulcrum 14, force T changes even through force P remains constant. Force T is still a multiple of force P but the multiplier now is the ratio of the sum of distances A and X to distance B.

It is not necessary that the fulcrum about which lever 12 rotates be located between the position at which input force P is applied and the position at which output force T results. Specifically the input and output arms of lever 12 may merge and be a single member with input force, denoted P in FIG. 1, being applied at a position between fulcrum 14 about which lever 12 rotates and the position at which output force T results. Accordingly, angle M between the input arm 20 and output arm 18 of lever 12 is immaterial; the two arms 20, 18 may be coincidental and embodied in a single member.

During operation, once traction cord 16 is connected between output arm 18 and the harness worn by the patient and slack due to harness slippage and the like is removed from the system, the position of output arm 18 and hence of lever 12 remains substantially constant. Position of rigid member 22 varies as the position of application of force P along input arm 20 is changed by movement of adjustable screw assembly 42.

It is desirable that operation be commenced with arm 20 positioned such that rigid member 22 is disposed perpendicularly to input arm 20. From such position, screw 41 may be rotated freely to increase or decrease the traction load by displacing rigid member 22 and moving roller 48 along input arm 20.

Conversely, if operation commences with arm 20 positioned such that rigid member 22 is not substantially perpendicular to input arm 20, roller 48 will tend to move towards or away from fulcrum 14 in response to hydraulic pressure on piston 28, according to whether angle N in FIG. 1 is respectively less than or greater than 90°. However, movement of roller 48 is prevented by reactive force in rod 46 being transferred via screw 41 and nut 44 to housing 40.

In such case torque required to rotate screw 41 is increased due to increased friction between screw 41 and nut 44 and in addition either increased further or reduced, according to whether movement of screw 41 opposes or is aided by reactive force in rod 46. In either case screw 41 is not so freely rotatable as when arm 20 is substantially perpendicular to rigid member 22 and, consequently, adjustment of traction force in cord 16 is less easy.

Figure 2:
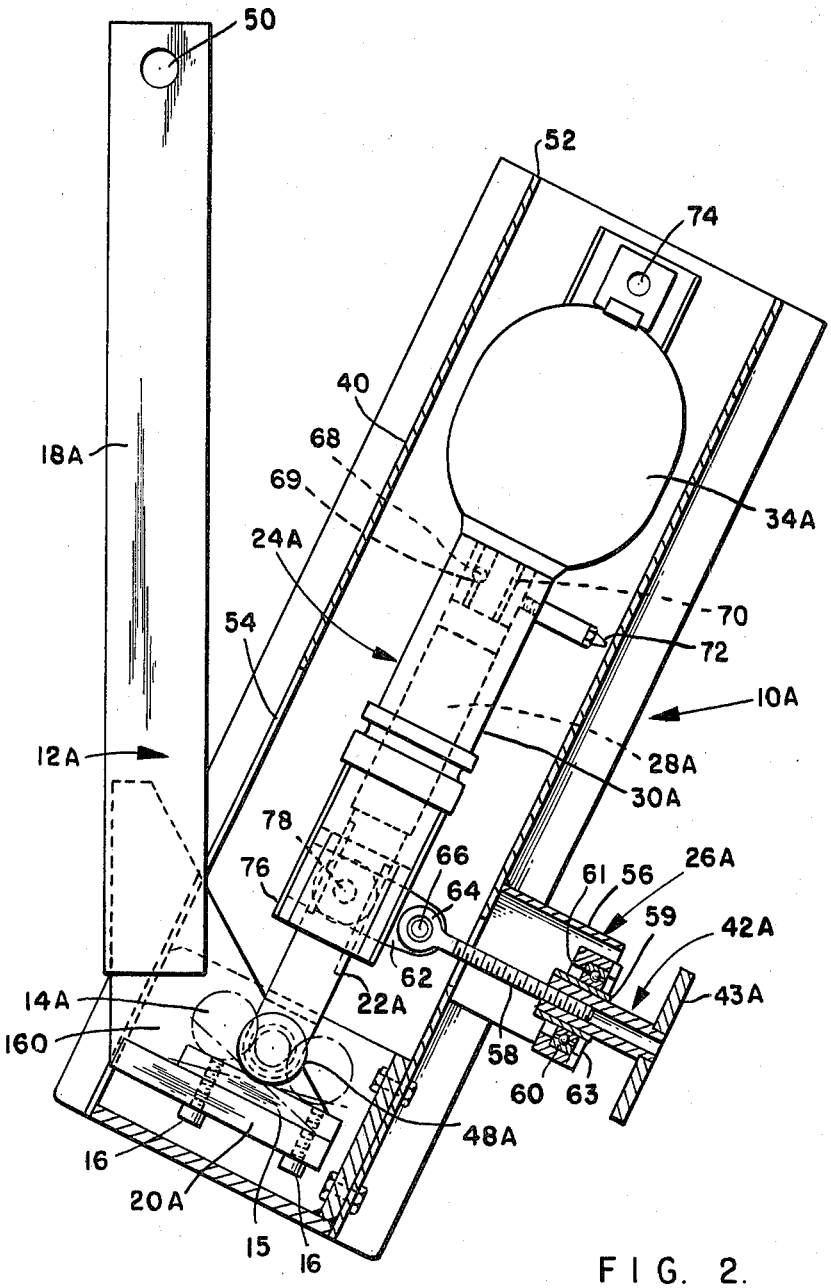
FIG. 2 is a top, view partially in section, of apparatus manifesting the invention.
Figure 3:
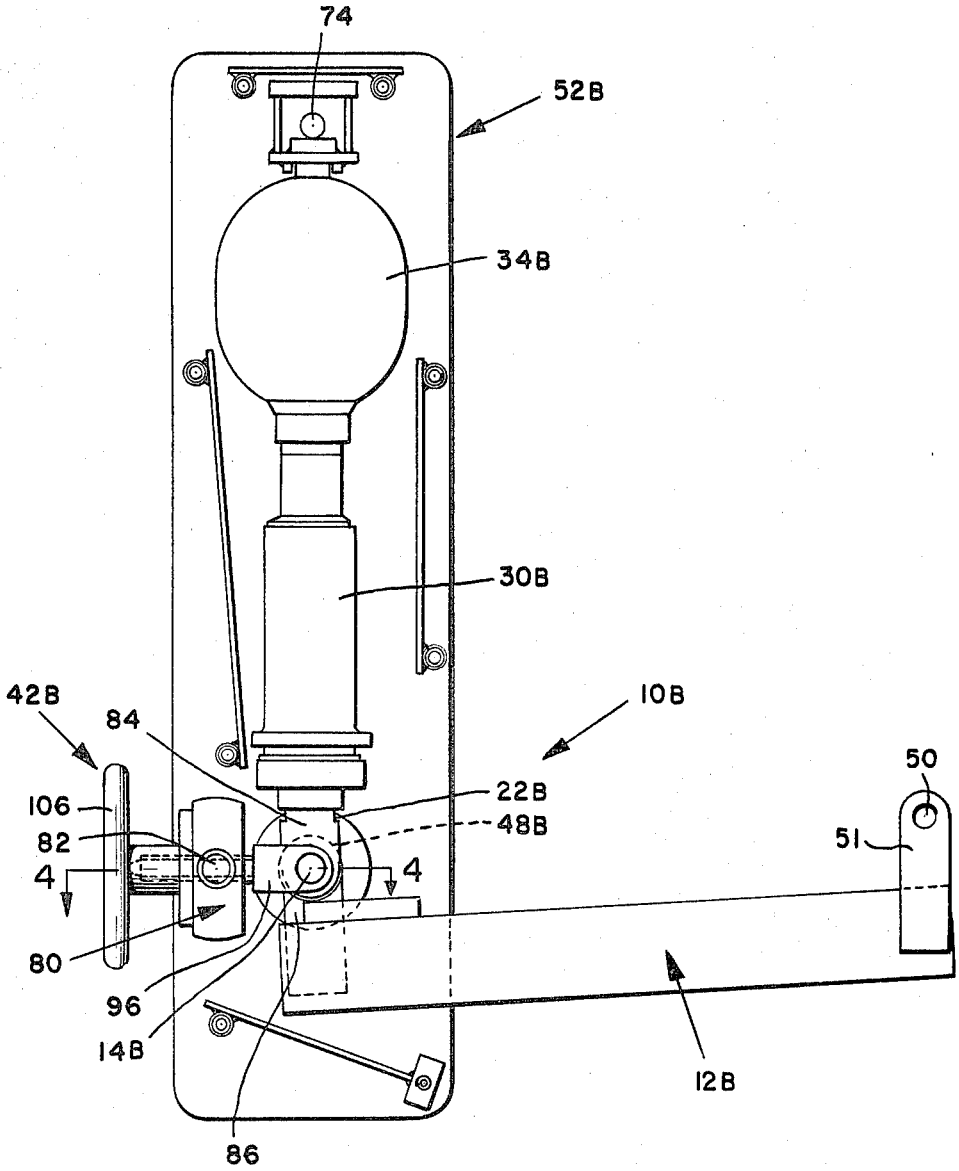
FIG. 3 is a top view, broken away, of additional apparatus manifesting the invention.
Figure 4:
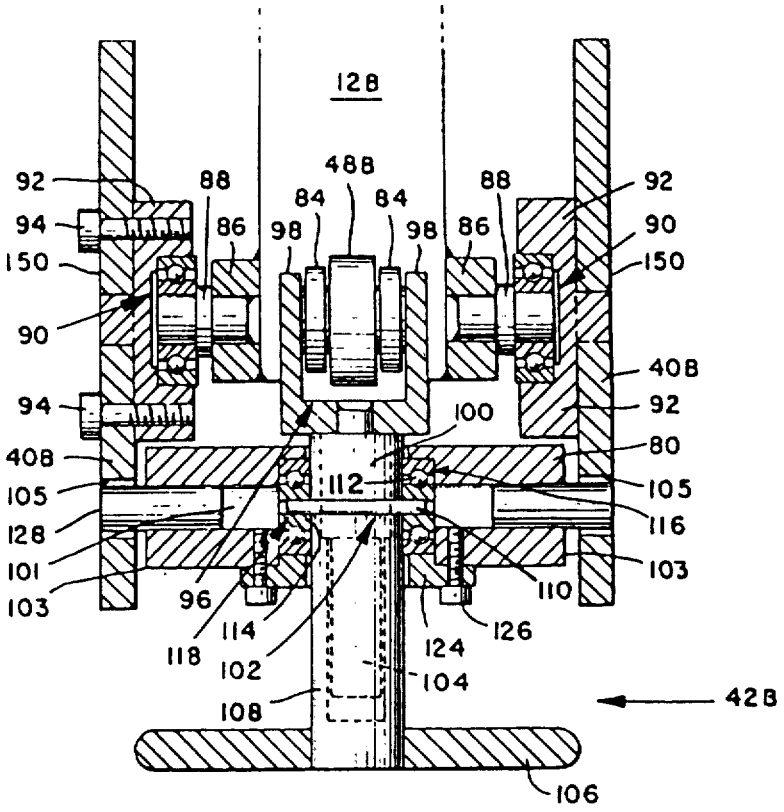

In FIGS. 2 and 3 functional equivalents of elements depicted in FIG. 1 are denoted by the same indicator numerals. In FIG. 2 the indicator numerals for functional equivalents have the letter A added thereto while in FIG. 3 the letter B has been added thereto.

Referring to FIG. 2, wherein apparatus embodying the invention is denoted generally 10A, the biasing means is denoted generally 24A and the adjusting means is denoted generally 26A, lever 12A pivots about a fulcrum 14A and includes output and input arms 18A and 20A with output arm 18A including an aperture 50 for securement thereto of a traction cord, not shown.

Webs 160 connecting output and input arms 18A and 20A and provide a mounting place for fulcrum 14A. Webs 160 are spaced apart to bracket input and output arms 18A, 20A and allow lever 12A to pivot about fulcrum 14A without the need for a shaft member, coaxial with the pivot of fulcrum 14A, connecting webs 160 together.

As illustrated in FIG. 2, rigid member 22A extends from the lower end of a piston 28A resident within a cylinder 30A extending securedly downwardly from reservoir 34A. A housing 52 encloses reservoir 34A, cylinder 30A, rigid member 22A and lever input arm 20A, with lever 12A pivoting about fulcrum 14A providing a pivotal connection between lever 12A and housing 52. Lever output arm 18A is generally exterior of housing 52. An opening 54 in housing wall 40 permits output arm 18A of lever 12A to rotate about fulcrum 14A without interfering with the housing wall. Rigid member 22A rides on input arm 20A via a roller 48A rotatable about an axis parallel to the axis of rotation of lever 12A provided by fulcrum 14A. Any suitable bearing may be used to retain roller 48A rotatably at the end of rigid member 22A. The end of rigid member 22A having roller 48A journaled thereon is bracketed between webs 160 and movable therewithin but not substantially contacted thereby.

An adjustable screw assembly 42A is secured in an extension tunnel 56 of housing 52. Screw assembly 42A includes a threaded shaft 58 extending inwardly through tunnel 56 towards rigid member 22A and includes nut 59 secured to a handwheel 43A for rotation unitarily therewith. Shaft 58 is preferably pivotally connected to an ear 62 via an eye 64 formed at the end of shaft 58, by a cylindrical coupling 66 rotatably centrally received by eye 64 and an aperture central of ear 62. The aperture is not visible in FIG. 2.

Between cylinder 30A and reservoir 34A are a check valve, indicated generally 68 in a passageway 69, and a passageway 70 connecting cylinder 30A to reservoir 34A for flow of first hydraulic fluid therebetween. Check valve 68 is shown schematically. Check valve 68 has a cross-sectional area for fluid flow, at the check valve seat when the check valve stem is spaced therefrom, substantially larger than the cross-sectional area of passageway 70 connecting cylinder 30A and reservoir 34A. This arrangement of check valve 68 and passageway 70 permits unrestricted flow of hydraulic fluid from cylinder 30A to hydraulic fluid reservoir 34A while confining flow of hydraulic fluid in the reverse direction to passageway 70. Consequently, passageway 70 acts as a damper with respect to flow of hydraulic fluid between hydraulic reservoir 34A and cylinder 30A. This insures that should traction force suddenly be released due to, for example, breakage of the traction cord, piston 28A will move only slowly, thereby preventing violent motion of lever 12A.

Thrust bearing 60 is mounted in bearing block 61 and held therein by bearing cap plate 63. Thrust bearing 60 houses nut 59, permitting rotation of the latter about a common axis with threaded shaft 58.

Bearing block 61 is preferably pivotally connected to tunnel extension 56 with the pivot axis preferably passing through thrust bearing 60 in a direction parallel to the axis of pivot 74. The pivotal mounting of bearing block 61 facilitates movement of rigid member 22A towards or away from fulcrum 14A in response to rotation of handwheel 43A. The pivotal mounting of bearing block 61 with respect to tunnel extension 56 is not shown in FIG. 2.

A roller pad 15 is secured to input arm 20A by screws 16 to facilitate replacement in case of wear; roller 48A rides on roller pad 15.

To minimize any variation in force applied to input arm 20A of lever 12A by biasing means 24A which might be caused by rotation of lever 12A about fulcrum 14A, the axes of fulcrum 14A and roller 48A are preferably parallel with one another and in a common plane, substantially parallel to the plane of the surface of roller pad 15. It is further preferable that roller 48A and roller pad 15 be configured so that the axis of roller 48A may be coaxially aligned with the axis of fulcrum 14A in the initial position. Indeed, note that in the embodiment illustrated in FIG. 2, lever 12A, screw assembly 26A, rigid member 22A and biasing means 24A may be adjusted so that at the initial position the axis of roller 48A is coaxial with the axis of fulcrum 14A. Alternate positions of roller 48A, illustrating the ability of roller 48A to move along lever input arm 20A, are shown in dotted lines in FIG. 2. This is desirable to allow rotatable positioning of lever 12A, when initial force is applied by biasing means 24A, without the initial force changing as lever 12A is rotated.

An auxiliary nipple 72 extends laterally from cylinder 30A, allowing fluid to be introduced initially to cylinder 30A.

In the embodiment illustrated in FIG. 2 rigid member 22A extends axially from piston 28A and is rigidly secured thereto. Piston 28A is axially elongated so that independent movement of piston 28A, other than axially within cylinder 30A, is precluded. Cylinder 30A is rigidly secured to reservoir 34A and includes sealing means, not shown in FIG. 2, in slideable contact with piston 28A to prevent escape of hydraulic fluid from cylinder 30A. Rigid member 22A and the biasing means including piston 28A, cylinder 30A and reservoir 34A are movable unitarily about a pivot 74 at which reservoir 34A is rotatably connected to housing 52. The structure of pivot 74 is preferably chosen so that reservoir 34A and the structural elements connected thereto are movable arcuately and only in a plane at least parallel with and preferably in common with that in which lever 12A pivots about fulcrum 14A.

Ear 62, via which threaded shaft 58 is connected to rigid member 22A, is affixed to a sleeve 76 fitted to and extending from cylinder 30A. Bearing means 78 provides structural connection between sleeve 76 and rigid member 22A while allowing relative motion of these two members with respect to one another in a direction parallel to the direction of relative movement between piston 28A and cylinder 30A.

Upon longitudinal displacement of threaded shaft 58, due to the connection provided by bearing 78 the axially elongated combination of rigid member 22A, piston 28A, cylinder 30A and reservoir 34A move arcuately about pivot 74, thereby altering the position at which roller 48A contacts portion 20A of lever 12.

FIG. 3 shows another embodiment of apparatus manifesting the invention with certain parts, which are substantially the same as parts illustrated in FIG. 2, omitted for clarity. The apparatus is denoted generally 10B and includes a lever 12B pivotable about a fulcrum 14B with a roller 48B journaling a rigid member 22B against lever 12B. Rigid member 22B is connected to a piston, not shown, housed within a cylinder 30B fluidically connected to a reservoir 34B by a check valve and passageway combination equivalent to check valve 68 and passageway 70 in FIG. 2; the check valve-passageway combination has not been illustrated in FIG. 3.

Reservoir 34B, cylinder 30B, the piston and rigid member 22B are unitarily arcuately movable about a pivot 74 connecting reservoir 34B to housing 52B.

Figure 4:
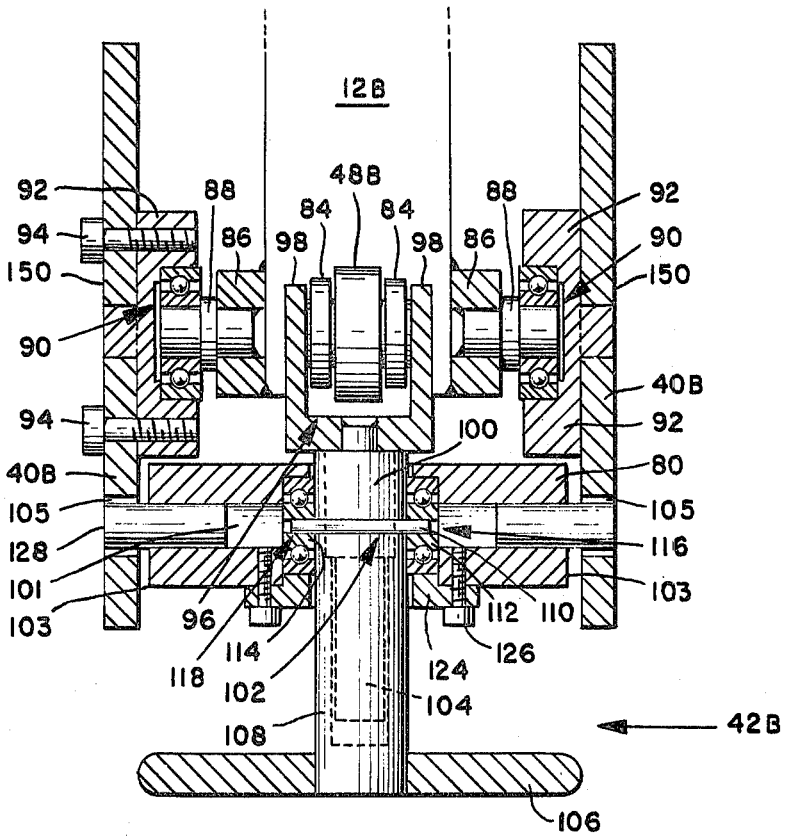
FIG. 4 is a sectional view at 4—4 in FIG. 3.

In the embodiment illustrated in FIG. 3, lever 12B has input and output arms combined into a single structure. Lever 12B includes an aperture 50 formed in an ear 51 extending laterally from one end of lever 12B, with aperture 50 disposed to receive a traction cord, not shown. An adjustable screw assembly 42B pivots about a third pivot 82 housed within a thrust block denoted generally 80 secured to the wall of housing 52B. Screw assembly 42B includes a clevis 96, bracketing fork prongs 84 retaining roller 48B, for movement thereof by rotation of handle 106 of screw assembly 42B; this is illustrated in FIG. 4.

Roller 48B is retained between two prongs 84 of an unnumbered fork formed at the end of rigid member 22B. Roller 48B rotates about a shaft, not shown, retained within conventional bearings preferably held by prongs 84.

Two drilled ears 86 are secured to lever 12B, preferably by welds, with the drilled holes aligned to define a common axis about which lever 12B rotates. Secured within the drilled holes and projecting outwardly of ears 86 are bearing pins 88, retained within inner annular races of bearing assemblies 90, which facilitate arcuate movement of lever 12B about fulcrum 14B defined by the inner annular races of bearing assemblies 90. Outer races of bearing assemblies 90 are retained in a bearing housing 92 secured to side walls 40B of housing 52B by machine bolts 94.

Roller 48B associated with rigid member 22B is displaced along lever 12B by a clevis 96 having two prongs 98 bracketing prongs 84. The shaft on which roller 48B rotates may be journaled in bearings in both prongs 84 and in prongs 98 or may reside slideably in one pair of prongs, either prongs 84 or prongs 98, and be journaled in bearings retained in the remaining pair of prongs.

Facingly abutting clevis 96 and extending outwardly therefrom is an enlarged shoulder portion 100 of a cylindrical shaft designated generally 102, where shaft 102 has a smaller, unnumbered portion fitted within clevis 96 and secured thereto, preferably by welds. Extending outwardly from shoulder 100 away from clevis 96 is an externally threaded extension portion 104 of shaft 102. A handle 106 is fixedly connected to an internally threaded sleeve 108 with internal threads of sleeve 108 engaging external threads of extension 104. A flange 110 fixedly connected to sleeve 108 is retained between respective facing inner cylindrical races 112, 114 of bearing assemblies 116, 118.

The unnumbered outer races of bearing assemblies 116, 118 are retained within thrust block 80 by an annular collar 124 secured to thrust block 80 by machine screws 126. A hole 101 passes transversely through bearing block 80 in a direction substantially perpendicular to housing wall 40B. The axis of hole 101 preferably passes through, or close to, the axis of shaft 102. Pivot pins 128, which are interference fitted into hole 101, are respectively pressed into ends of hole 101, such that each pin 128 protrudes from thrust block 80 a distance approximately equal to the distance between faces 103 of bearing block 80 and the exterior, outwardly facing surfaces 150 of the adjacent housing wall 40B.

Protruding ends of pivot pins 128 are rotatably mounted in bearings 105 retained within housing walls 40B. Bearings 105 may be ordinary bearings as shown schematically in FIG. 4, but preferably are ball bearings, to eliminate radial play between pins 128 and housing wall 40B. Flange 110, retained between bearing assemblies 116, 118, transfers any thrust load received by the screw assembly, resulting from reaction between roller 48B and lever 12B, to housing walls 40B via thrust bearings 116 and 118, thrust block 80, pivot pins 128 and pivot bearings 105.

Due to threaded engagement of sleeve 108 with portion 104 of shaft 102, rotation of handle 106 results in longitudinal displacement of shaft 102 and clevis 96, thereby moving roller 48B along lever 12B.

Retention of flange 110 within cylindrical bearing races 112, 114 not only serves to transfer reaction forces between roller 48B and lever 12B to housing 52B but also permits rotation of bearing block 80 about an axis 82 passing through pivot pins 128. As a result, bearing block 80, thrust bearings 116 and 118 and screw assembly 42A rotate about this axis, denoted 82 in FIG. 3, as roller 48B moves along lever 12B.

Lever 12B is shown in FIG. 3 in the preferred initial position at which rigid member 22B is perpendicular to a preferably planar portion of lever 12B on which roller 48B rides and the axes of roller 48B and pivot point 14B coincide. In this position the distance between roller 48B and fulcrum 14B is zero and, therefore, traction force exerted by lever 12B on the traction cord is zero, while screw assembly 42B may be rotated by handle 106 to produce the traction load.

The axis of rotation of lever 12B about fulcrum 14B, the axis 82 of rotation of screw assembly 42B and the axis of rotation of rigid member 22B at pivot 74 are preferably parallel. This provides smooth, coplanar movement of the various parts of the invention as traction force is applied and varied.

It is preferable that distance from the point at which roller 48 contacts input arm 20 to the point about which rigid member 22 rotates, i.e. juncture of rigid member 22 and piston 26 in FIG. 1 or pivot 74 in FIGS. 2 and 3, be large relative to allowable transverse displacement of roller 48 along input arm 20 as controlled by screw assembly 42. Such configuration results in little difficulty being encountered in turning screw 42 when lever 12 is in the preferred initial position because longitudinal movement of second rod 46 and hence transverse displacement of roller 48 does not result in substantial longitudinal movement of rigid member 22 and hence little work need be input to reservoir 34 to move piston 28.

To minimize the size of the apparatus while at the same time minimizing the change in traction force as lever 12 rotates about pivot point 14 it is advantageous to utilize compressible fluid under relatively high pressure in bladder 38.

Apparatus embodying the invention has been successfully operated where roller 48 has been limited to about two and one-half inches of travel along input arm 20 and the assembly of rigid member 22 and members connected thereto has had length about 15 inches from the point of contact of roller 48 with lever 12 to pivot 74. Nitrogen compressed to 80 atmospheres has been used as the second, compressible fluid in bladder 34, cylinder 30 has been about 1.12 inches diameter and the point of attachment of the traction cord to the output arm of the lever has been about 13 inches from fulcrum 14.

An auxiliary rope and pulley system may be affixed to lever 12 to facilitate repositioning of lever 12 after the traction load is initially applied to the patient. This may be desirable since upon initial application of the traction load, the harness worn by the patient may stretch or slip as the load is applied. This stretch or slip is taken up by movement of lever 12. Consequently if the apparatus is initially positioned with rigid member 22 substantially perpendicular to input arm 20, harness slip or stretch with consequent movement of lever 12 causes rigid member 22 to move away from the desired orientation perpendicular to lever 12. The auxiliary rope and pulley system facilitates return of the apparatus to the desired initial position before the physician, physiotherapist or patient begins to adjust traction force by rotating screw assembly 42. Manipulation of the auxiliary rope and pulley system also provides a convenient way of affecting intermittent application of the traction force.

The auxiliary rope and pulley system may be actuated by an electric winch. The electric winch may be programmed to affect intermittent application or variation of the traction force.

An electric motor may be substituted to perform the function of the auxiliary rope and pulley.

An electric motor may also be connected to screw assembly 42 and programmed to provide a desired pattern of variation in traction force as a function of time.

Besides providing means for varying the applied traction force, screw assembly 42 maintains rigid member 22 in an operator-selected position. This is necessary since, if operation begins with rigid member 22 perpendicular to input arm 20, once force P is applied and screw 42 is rotated to displace rigid member 22 and roller 48 along input arm 20, continued application of force P tends to continue to move roller 48 along input arm 20, further away from the initial position. Screw assembly 42 prevents this.

If desired, the force application means represented by the combination of piston 26, cylinder 28 and reservoir 34 may be replaced by a system of weights and pulleys.

The invention has been used to apply traction loads ranging from 1 to 100 kg. Travel of the portion of lever 12 to which the traction cord is affixed is normally limited to about 20 cm. Adjustable screw 42 permits the attending physician or physiotherapist to adjust traction force rapidly, thereby facilitating application of a time varying traction force.

I claim:

1. Apparatus for application of traction force to patient, comprising:

a. cord means for applying a constant traction force to the patient;

b. a lever rotatable about a pivot and capable of being connected to said cord means remote said pivot;

c. a member journaled against said lever and movable therealong;

d. means for biasing said member against said lever with a force independent of displacement of said member along said lever in a direction generally transverse to the portion of said lever against which said member is journaled to maintain a predetermined traction force substantially constant; and e. adjustable means for displacing said member along said lever as force is applied by said biasing means thereby changing distance between said pivot and where said member is journaled against said lever thereby changing force applied to said cord means to set said predetermined traction force.

2. Apparatus for contolling traction force applied to a patient, comprising:

a. cord means for applying a constant traction force to the patient;

b. a lever mounted for rotation about a pivot adapted for connection to said cord means at a position on said lever remote said pivot;

c. a piston within a cylinder, movable in response to fluid pressure thereagainst in a direction generally transverse to said lever;

d. a rigid member connected to and extending from said piston, journaled against said lever, for movement therealong in response to piston movement; and e. adjustable screw means connected to said rigid member intermediate said piston and said lever, for displacing said rigid member along said lever while hydraulic pressure is applied to said piston.

3. Apparatus of claim 2 wherein said adjustable screw means for displacing said second rod member is pivotable about an axis parallel the axis of rotation of said lever.

4. Apparatus for controlling traction force applied to a patient, comprising:

a. cord means for applying a constant traction force to the patient;

b. a hollow housing;

c. a lever within and connected to said housing at a fulcrum for pivotal movement with respect thereto about said fulcrum, adapted for connection to said cord means at a position remote said fulcrum;

d. a cylinder affixed to said housing and having fluid therewith;

e. a piston slideably resident within said cylinder, said fluid contacting said piston in said cylinder;

f. means for applying force to said piston by increasing pressure of said fluid within said cylinder;

g. a rigid member extending from said piston in a direction generally transverse to said lever, journaled against said lever for movement therealong; and h. manually adjustable means, connected to said rigid member between said housing and said rigid member, for displacing said rigid member along said lever in response to manual operator input.

5. Apparatus of claim 4 wherein said rigid member is movable along said lever to a position where a portion of said rigid member is coincident with said fulcrum.

6. Lightweight portable apparatus for controlling traction force applied to a patient, comprising:

a. cord means for applying a constant traction force to the patient;

b. a hollow housing having an orifice therein for passage therethrough of said cord means;

c. a lever within said housing and pivotally connected thereto at a fulcrum, said lever including a generally planar pad portion, said pad portion extending along said lever to a position proximate said fulcrum, said lever being adapted for connection to said cord means at position remote said fulcrum;

d. a closed hydraulic fluid reservoir interior of and pivotally mounted to said housing for arcuate movement coplanar with said lever;

e. a hydraulic cylinder in fluid communication with said reservoir;

f. a piston slidably resident within said hydraulic cylinder and movable longitudinally therealong in response to hydraulic fluid pressure thereagainst within said cylinder;

g. bladder means within said hydraulic fluid reservoir for increasing hydraulic fluid pressure upon introduction of a second fluid into said bladder means;

h. a first rod member fixedly connected to said piston for movement unitarily therewith, extending from said piston to said lever pad portion, generally transverse to said pad portion;

i. first bearing means rollably contacting said pad portion of said lever, said rod member journaled in said first bearing means, for facilitating movement of said rod member along said lever;

a portion of said first rod member including said first bearing means being movable along said lever to a position at which axis of rotation of said bearing is coaxially aligned with the axis of rotation of said lever as defined by said fulcrum;

j. a second rod member extending generally longitudinally from said first rod member, disposed in said plane of movement of said lever and said reservoir;

k. second bearing means, connecting said first and second rod members, facilitating angular movement of said first rod member along said lever upon longitudinal movement of said second rod member; and l. hand adjustable screw means connected to said housing and receiving said second rod member therewithin for longitudinally displacing said second rod member in response to operator manual screwing input.

7. Apparatus of claim 6 further comprising:

a. means located at fluid juncture of said hydraulic cylinder and said hydraulic reservoir, for blocking flow of said hydraulic fluid from said hydraulic fluid reservoir into said hydraulic cylinder while permitting flow of hydraulic fluid from said hydraulic cylinder into said hydraulic fluid reservoir; and b. a passageway connecting said hydraulic cylinder and said hydraulic fluid reservoir for flow of hydraulic fluid therebetween, said passageway having substantially smaller cross sectional area to fluid flow than the cross sectional area to fluid flow of said flow blocking and permitting means when said means is permitting fluid flow.

8. Apparatus of claim 7 wherein said means located at fluid juncture of said hydraulic cylinder and said hydraulic reservoir is a check valve.

9. Apparatus of claim 6 wherein said hydraulic cylinder, said piston and said first rod member are all rotatable unitarily with said hydraulic fluid reservoir and in a common plane therewith.

10. Apparatus of claim 9 wherein said hand adjustable screw means for displacing said second rod member is rotatable coplanarly with but independently of said hydraulic fluid reservoir.

11. Apparatus of claim 6 wherein said fulcrum is intermediate at least a portion of said lever pad and lever-cord juncture.

12. Apparatus of claim 6 wherein at least a portion of said lever pad is intermediate said fulcrum and lever-cord juncture.

13. Apparatus of claim 6 wherein said hydraulic fluid is an incompressible fluid.

14. Apparatus of claim 13 wherein said incompressible fluid is grease.

15. Apparatus of claim 14 wherein said second fluid is a compressible fluid.

16. Apparatus of claim 15 wherein said second fluid is a gas.

17. Apparatus of claim 16 wherein said gas is air.

18. Apparatus for controlling traction force applied to a patient, comprising:

a. cord means for applying a constant traction force to the patient;

b. a lever mounted for rotation about a pivot adapted for connection to said cord means at a position remote said pivot;

c. means movable along said lever for rotating said lever about said pivot by application of force to said lever; and d. means for adjustably displacing said force application means along said lever while said force is being applied by said force application means to said lever, thereby changing the ratio between distance along said lever from pivot to position where said force is applied against said lever and distance along said lever between said pivot and said lever-cord connective point thereby changing the amount of traction force applied to said cord means.

* * * * *

UNITED STATES PATENT AND TRADEMARK OFFICE

CERTIFICATE OF CORRECTION

PATENT NO. : 4,429,692

DATED : 2/7/84

INVENTOR(S) : George A. Carruthers

It is certified that error appears in the above-identified patent and that said Letters Patent is hereby corrected as shown below:

Column 10, line 59, delete "contolling" and insert --controlling--.

Fig. 4 of the drawing should be deleted to appear as shown on per attached sheet.

Signed and Sealed this

*Fourteenth* Day of *August 1984*

[SEAL]

*Attest:*

GERALD J. MOSSINGHOFF

*Attesting Officer*

*Commissioner of Patents and Trademarks*

Patent No. 4.429,692